US007789983B1

(12) United States Patent
Newman et al.

(10) Patent No.: US 7,789,983 B1
(45) Date of Patent: Sep. 7, 2010

(54) METHOD FOR MAKING INSENSITIVE ENHANCED BLAST EXPLOSIVE MOLDING POWDERS

(75) Inventors: Kirk E. Newman, Yorktown, VA (US); Steven L. Jones, Toano, VA (US); Lester B. Leonard, III, Williamsburg, VA (US); Mark D. Lowell, Gloucester, VA (US); Daren T. Knutson, Seaford, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 68 days.

(21) Appl. No.: 11/108,141

(22) Filed: Apr. 13, 2005

(51) Int. Cl.

| | |
|---|---|
| ***C06B 33/00*** | (2006.01) |
| ***C06B 33/02*** | (2006.01) |
| ***C06B 33/06*** | (2006.01) |
| ***C06B 29/00*** | (2006.01) |
| ***C06B 29/22*** | (2006.01) |

(52) U.S. Cl. ..... 149/109.6; 149/37; 149/42; 149/44; 149/75; 149/76

(58) Field of Classification Search ..... 149/109.6, 149/37, 42, 44, 75, 76
See application file for complete search history.

(56) References Cited

U.S. PATENT DOCUMENTS

| | | | | |
|---|---|---|---|---|
| 2,759,418 | A * | 8/1956 | Ross et al. | 102/313 |
| 3,014,796 | A * | 12/1961 | Long et al. | 149/19.7 |
| 3,377,909 | A * | 4/1968 | Grant et al. | 86/20.15 |
| 3,639,348 | A * | 2/1972 | D'Alelio | 525/153 |
| 5,516,971 | A * | 5/1996 | Hurley | 588/318 |
| 5,750,921 | A * | 5/1998 | Chan et al. | 149/19.92 |
| 2004/0197469 | A1 * | 10/2004 | Lyons et al. | 427/213.3 |

OTHER PUBLICATIONS

U.S. Appl. No. 10/729,264, filed Dec. 3, 2003, Newman et al.
Presentation by Nancy Johnson on Apr. 15, 2004 at NDIA 39th Annual Gun and Ammunition/Missiles and Rockets Confreence, Baltimore, MD.

* cited by examiner

*Primary Examiner*—Jerry Lorengo
*Assistant Examiner*—James E McDonough
(74) *Attorney, Agent, or Firm*—Fredric Zimmerman

(57) ABSTRACT

A method is provided for making blast explosive molding powder. According to an aspect of the invention, energetic solids and a metal powder are suspended in a bulk phase fluid. Lacquer is added to an energetic solids and metal powder suspension to achieve a super-saturated solution. Final granulation of the super-saturated solution is optimized to form a fluidized metallized energetic molding powder. The fluidized metallized energetic molding powder is distilled to remove an organic solvent component of the lacquer, which is reclaimed through distillation. The bulk phase fluid is decanted to recover a wet metallized energetic molding powder. The bulk phase fluid is reclaimed through distillation. The wet metallized energetic molding powder is dried to form a dry metallized energetic molding powder. This method is especially useful in making insensitive enhanced blast explosive molding powders with high metal powder content.

25 Claims, 2 Drawing Sheets

METHOD FOR MAKING INSENSITIVE ENHANCED BLAST EXPLOSIVE MOLDING POWDERS

GOVERNMENT LICENSING CLAUSE

The invention described herein may be manufactured and used by or for the Government of the United States of America for governmental purposes without the payment of any royalties thereon or therefore.

BACKGROUND OF THE INVENTION

1. Field of the Invention

The present invention relates to methods for making insensitive enhanced blast explosive molding powders, and more particularly to methods for making metallized energetic molding powder in a non-aqueous environment.

2. Description of Related Art

Energetic molding powder is used extensively as a component of explosives, warheads and similar ordnance components. Energetic molding powders are typically formed from a combination of energetic solids and a plasticized polymer processed in a bulk phase fluid. Often a metal powder is added to energetic molding powders for specific applications. Methods are available to produce energetic molding powders, which contain a metal powder, but the methods are inefficient, and resultant pressed energetic molding powder products have a number of problematic characteristics.

A common method to form a molding powder product, which contains a metal powder, involves a basic two-step process. The first step is performed in an aqueous environment. This process combines an energetic solid and a plasticized polymer in water, as the bulk phase fluid, to form a molding powder. The second step is mechanically blending the molding powder with a metal powder to form the molding powder product. Since the metal powder and, typically aluminum powder, exothermically reacts with water and generates hydrogen gas, the molding powder is made first then blended with the metal powder.

This process, in part, requires a jacketed tank to make the molding powder as well as an additional piece of process equipment, typically, a double-cone blender, to blend, mechanically and separately, the metallic powder. The additional blending step increases the time and cost per batch of product. This process can not be used to make large quantities of molding powder product (or stored for long periods of time) as the molding powder product exhibits settling problems and, typically, aluminum powder stratification results in undesirable density gradients in the explosive loads. Further, the molding powder is typically more sensitive to impact, fraction and electrostatic discharge stimuli, which result from the relatively hard, dense and gritty nature of the mechanically blended metal, such as, aluminum, powder or particles consolidated into the binder during pressing. Therefore, when sheared, the metal particles contribute to the onset of "hot spot" ignition.

A somewhat related method is available to make molding powder involving a hydrolyzable binder to extract nitramine using a bulk multi-component fluid, that is, a non-aqueous carrier fluid, typically, including a fluorocarbon fluid (or fluorinated oil) and ethyl acetate. This process is focused on an environmentally friendly method of making high explosive molding powder using the non-aqueous carrier fluid, which does not generate contaminated waste water, yet the process attempts to uniformly coat the high explosive with a binder in order to minimize batch-to-batch variations. This process does not contemplate combining the molding powder with a metal powder to produce a molding powder product.

Although efforts have been made to produce energetic molding powders, which contain a metal powder, these methods are ineffective, small batch processes. Thus, there is a need for an improved method of making novel and safe enhanced blast explosive molding powder products in large quantities.

SUMMARY OF THE INVENTION

In view of the foregoing and other problems, disadvantages and drawbacks of the conventional methods of making molding powder products, the present invention has been devised, and it is an object of the present invention to provide a method for making insensitive enhanced blast explosive molding powders, which eliminates the need for mechanically dry blending the metal powder but allows for high metal powder content.

Another object of the invention is to provide a safe method for making insensitive enhanced blast explosive molding powders where the blast explosive molding powders are an insensitive homogenous product.

It is another object to provide a method for making insensitive enhanced blast explosive molding powders where the blast explosive molding powders are uniformly coated with a binder and do not easily self-adhere.

A further object of the invention to provide a method for making insensitive enhanced blast explosive molding powders with significantly reduced sensitivity to impact, friction and shock stimuli.

It is still another object of the invention is to provide a method for making insensitive enhanced blast explosive molding powders without settling or density gradient problems.

A further object of the invention is to provide a method for making insensitive enhanced blast explosive molding powders using a non-aqueous performance fluid, which is recycled for reuse.

In accordance with the purpose of the invention as embodied and broadly described herein, and to achieve one or more of the above-described objects, a first aspect of the invention provides a method for making blast explosive molding powder. The method includes suspending energetic solids and a metal powder in a bulk phase fluid to form an energetic solids and metal powder suspension, adding lacquer to the energetic solids and metal powder suspension to achieve a super-saturated solution, in which the super-saturated solution includes a lacquer, fluidized energetic solids and metal powder, optimizing for final granulation of the super-saturated solution to form a fluidized metallized energetic molding powder, distilling the fluidized metallized energetic molding powder through a first distillation process to remove an organic solvent component of the lacquer, reclaiming the organic solvent component through the first distillation process, decanting the bulk phase fluid to recover a wet metallized energetic molding powder, reclaiming the bulk phase fluid through a second distillation process for reuse of the bulk phase fluid, and drying the wet metallized energetic molding powder in an oven to form a dry metallized energetic molding powder.

In accordance with the purpose of the invention as embodied and broadly described herein, and to achieve one or more of the above-described objects, a second aspect of the invention provides a method for making blast explosive molding powder. The method includes suspending energetic solids and a metal powder in a non-aqueous bulk phase fluid at a predetermined range of non-aqueous bulk phase fluid to explosive ratio to form an energetic solids and metal powder suspension with a maximized substrate area, dissolving binder components in organic solvent to make a lacquer using a vessel, adding the lacquer to the energetic solids and metal powder suspension at a predetermined range of solvent to polymer ratio to achieve a super-saturated solution, in which the super-saturated solution includes a lacquer, fluidized energetic solids and metal powder, depositing the lacquer on at least one of the fluidized energetic solids and the metal powder to result in granulation of and formation of a fluidized metallized energetic molding powder, optimizing for final granulation of the super-saturated solution to form a fluidized metallized energetic molding powder, distilling the fluidized metallized energetic molding powder through a first distillation process to remove an organic solvent component of the lacquer, reclaiming the organic solvent component through the first distillation process, decanting the bulk phase fluid to recover a wet metallized energetic molding powder, reclaiming the bulk phase fluid through a second distillation process for reuse of the non-aqueous bulk phase fluid, and drying the wet metallized energetic molding powder in an oven to form a dry metallized energetic molding powder.

In accordance with the purpose of the invention as embodied and broadly described herein, and to achieve one or more of the above-described objects, a third aspect of the invention provides a method for making blast explosive molding powder. The method includes suspending energetic solids and a metal powder in a non-aqueous performance fluid at a non-aqueous bulk phase fluid to explosive ratio in a predetermined range of 5 to 7 to form an energetic solids and metal powder suspension with a maximized substrate area, dissolving binder components in organic solvent to make a lacquer using a vessel, adding the lacquer to the energetic solids and metal powder suspension at a solvent to polymer ratio in a predetermined range of 14 to 18 to achieve a super-saturated solution, in which the super-saturated solution includes a lacquer, fluidized energetic solids and metal powder, depositing the lacquer on at least one of the fluidized energetic solids and the metal powder to result in granulation of and formation of a fluidized metallized energetic molding powder, optimizing for final granulation of the super-saturated solution at a performance fluid to solvent ratio in a predetermined range of 15 to 25 to form a fluidized metallized energetic molding powder, distilling the fluidized metallized energetic molding powder through a first distillation process at a performance fluid to solvent ratio in a predetermined range of 15 to 25 to remove an organic solvent component of the lacquer, reclaiming the organic solvent component through the first distillation process, decanting the bulk phase fluid to recover a wet metallized energetic molding powder, reclaiming the bulk phase fluid through a second distillation process for reuse of the non-aqueous bulk phase fluid, and drying the wet metallized energetic molding powder in an oven to form a dry metallized energetic molding powder.

BRIEF DESCRIPTION OF THE DRAWINGS

The accompanying drawings are incorporated in and constitute a part of the specification. The drawings, together with the general description given above and the detailed description of the embodiments and methods given below, serve to explain the principles of the invention. In such drawings.

DETAILED DESCRIPTION OF EMBODIMENTS AND METHODS OF THE INVENTION

Figure 1:
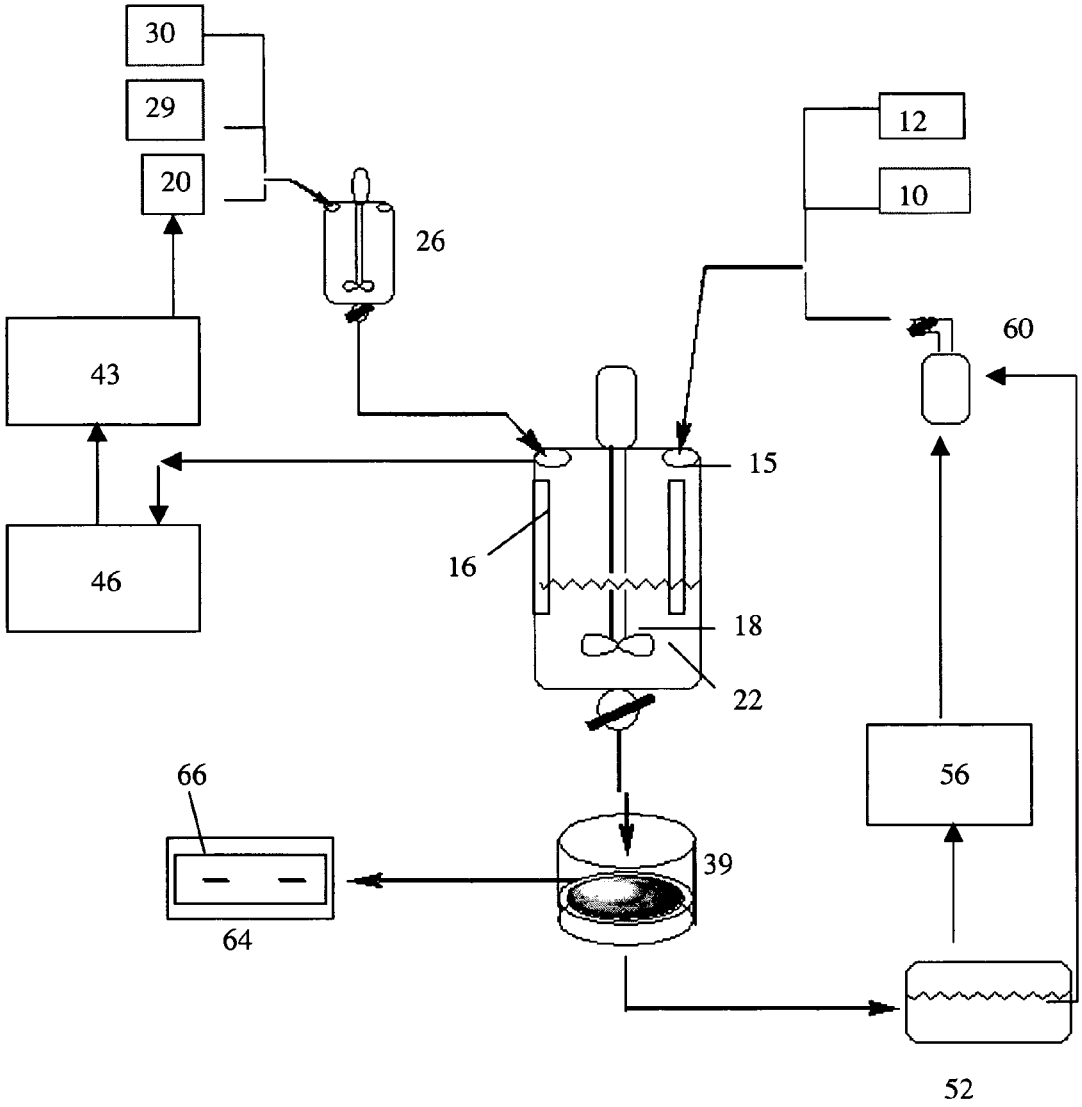
FIG. 1 is a flow diagram of equipment used in a method of making metallized energetic molding powder in a non-aqueous bulk-phase fluid environment according to an embodiment of the invention.

Reference will now be made in detail to the embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in this section in connection with the embodiments and methods. The invention according to its various aspects is particularly pointed out and distinctly claimed in the attached claims read in view of this specification, and appropriate equivalents.

It is to be noted that, as used in the specification and the appended claims, the singular forms "a," "an," and "the" include plural referents unless the context clearly dictates otherwise.

As mentioned above, there is a need for a method for making insensitive enhanced blast explosive molding powders with increased metal powder content, improved (type) sensitivity and homogeneity, and significantly reduced density gradients. In order to meet these needs, the invention combines an energetic solid and an metal powder in a non-aqueous bulk phase fluid to produce the resultant metallized energetic molding powder. The advantage conferred by this method provides a metallized energetic molding powder uniformly coated with a desensitizing binder. Applicants' invention eliminates the relatively hard, dense and gritty nature of mechanically blended particles consolidated onto a binder during pressing as produced by conventional processes. Accordingly, a metallized energetic molding powder uniformly coated with a desensitizing binder is less sensitive to impact, friction, and electro-static discharge stimuli thus (significantly reducing or eliminating) "hot spot" ignitions.

Figure 2:
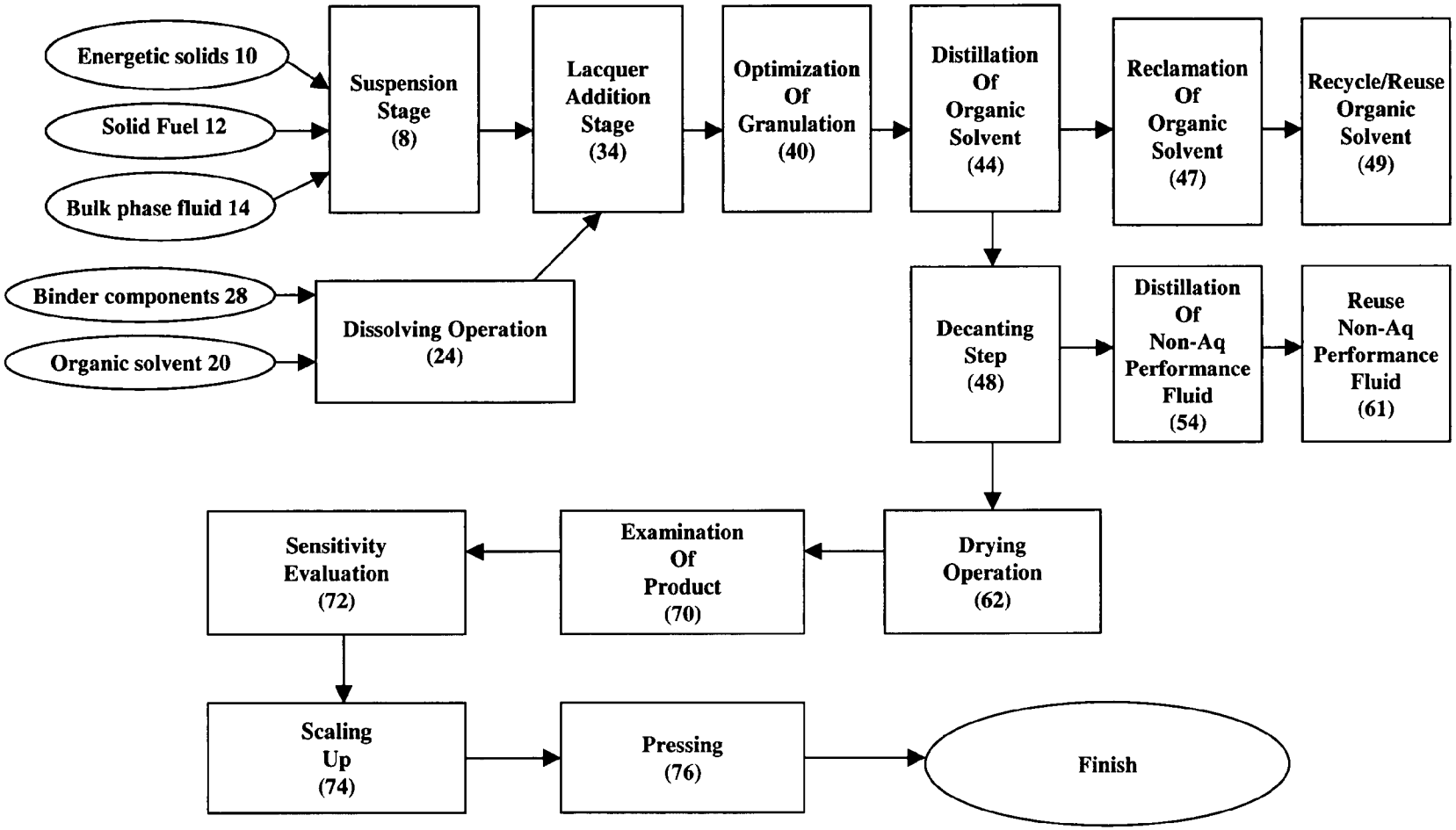
FIG. 2 is a flowchart of a method making metallized energetic molding powder in a non-aqueous bulk-phase fluid environment.

An embodiment of a method of the present invention is illustrated in flowchart format in FIG. 2. In a suspension stage 8, energetic solids 10 and a solid fuel 12, for example, a metal powder, are suspended in a bulk phase fluid 14 to form an energetic solids and metal powder suspension 22. A variety of energetic solids 10 may be used, alone, including, for example, nitramines molding powders comprising cyclo-tetramethylene tetranitramine ("HMX"), molding powders comprising a crystalline explosive powder, such as, cyclotrimethyene trinitriamine ("RDX") or hexanitro-hexaazaisowurtzitane ("Cl-20"). The energetic solids 10 may also be used in combination with water-soluble and non-water soluble oxidizers, such as, ammonium perchlorate ("AP") or polytetrafluoroethene ("Teflon"). In an exemplary embodiment, Table 4, Product 8, includes polytetrafluoroethene. In another exemplary embodiment, Table 4, Product 10, includes ammonium perchlorate. An exemplary energetic solid is nitramine molding powder comprising HMX.

Further, the energetic solids 10 may also be used with additional components, such as, nitrate esters, metals and a combustible powder. In exemplary embodiments, these additional components may include ammonium perchlorate, commercial double-base propellant ("Bulls Eye® (Hercules)), trimethylolethane trinitrate ("TMETN"), flaked aluminum powder ("Al flitters"), and bituminous coal powder ("coal powder").

A variety of metal powders 12 may be used, alone or in combination. The metal in the powder may include, for example, aluminum, magnesium, zirconium, boron, and magnalium (a Mg/Al alloy). An exemplary metal powder is aluminum molding powder.

A feature of the invention is that the bulk phase fluid 14 is a non-aqueous bulk-phase fluid 14, whereas the conventional processes often used an aqueous bulk-phase fluid, and, in particular, water. In particular, the non-aqueous bulk-phase fluid 14 is a single component, which is effective in forming a miscible system of a single phase bulk fluid and one organic solvent. The organic solvent is added as a lacquer with a plasticized polymer (see below). A variety of non-aqueous bulk-phase fluids 14, that is, non-aqueous performance fluids, may be used, including, for example, a perfluorocarbon performance fluid, such as, the commercially known 3M PF-5080, or ethoxy-nonafluorobutane, such as, the commercially known 3M HFE-7200. Accordingly, a bulk phase fluid 14 is referred to herein as a non-aqueous bulk phase fluid 14 or non-aqueous performance fluid 14.

An exemplary non-aqueous performance fluid 14 is the perfluorocarbon performance fluid, which is fully fluorinated. The perfluorocarbon performance fluid includes at least the following four properties.

First, the perfluorocarbon performance fluid 14 includes a boiling point of about 100±5° C., which is higher than an organic solvent 20 (see below), which includes a boiling point of about 75±5° C. The high boiling point enables distillation stripping of the organic solvent while maintaining a suspension.

Second, the perfluorocarbon performance fluid 14 includes a specific gravity of at least, that is, greater than or equal to (≧) 1.40 g/cc (at 25° C.). This property enables adequate suspension of the metal powder and the energetic solid, such as, the nitramine (and/or oxidizer), for binder precipitation and particle granulation (see below).

Third, the perfluorocarbon performance fluid 14 needs to be immiscible with the organic solvent 20. This property enables a decanting step (see below) to recover the bulk phase fluid 14 for reuse.

Fourth, the perfluorocarbon performance fluid 14 needs to be compatible, that is, un-reactive, with the molding powder. This property prevents an undesired chemical reaction that could otherwise result in safety or quality problems.

A second exemplary non-aqueous performance fluid 14 is the ethoxy-nonafluorobutane, which is not fully fluorinated. The ethoxy-nonafluorobutane is capable of fluidizing a suspension but has solubility characteristics, which may interfere with particle granulation as well as cause distillation and recovery problems for a few highly metallized formulations. However, it is acceptable for most applications. In contrast, the conventional technology does not use ethoxy-nonafluorbutane or a generic multi-component fluorocarbon with ethyl acetate.

Referring back to the process steps, the suspension stage 8 is performed in a jacketed reactor 15 referred to as "a molding powder vessel." The jacketed reactor 15, or molding powder vessel, includes a baffled tank portion 16 and a mixing impeller 18 for suspending the components and baffles to produce vertical mixing vortices. An exemplary embodiment is a 100 gallon molding powder vessel. The molding powder vessel 15 is charged with the bulk phase fluid 14. The molding powder vessel 15 is energized and the mixing impellers 18 are generally run at an agitation speed in a predetermined range of about 150 rpm to about 250 rpm, a temperature in a predetermined range of 35-65° C., at atmospheric pressure in a time range of about 30-60 minutes. The energetic solids 10 and the metal powder 12 are added either separately or simultaneously inside the molding powder vessel 15 into the bulk-phase fluid 14. If the components are separately added, then, in an exemplary embodiment, the energetic solids 10 are added and the metal powder 12 is subsequently added, and agitator speed may be adjusted to maintain a suspension. Regardless of the sequence, a ratio (β) of non-aqueous performance fluid to explosive is in a predetermined range of 4 to 7 to form the energetic solids and metal powder suspension 22 with maximized substrate surface area.

The non-aqueous performance fluid to explosive ratio (β) is a parameter of the suspension stage 8. The non-aqueous performance fluid 14 suspends and separates the energetic solids 10, for example, nitramine particles, in a constantly agitated environment. Importantly, the mass of non-aqueous performance fluid 14, or bulk phase fluid, is in excess of a batch weight, that is, the mass of dry metallized energetic molding powder product, that is, to be produced in a single batch. The ratio of non-aqueous performance fluid 14 to the batch weight ensures that a concentration of the suspension 22, that is, the energetic solids and metal powder suspension 22, is sufficiently dilute to promote the formation of property sized molding powder granules during a distillation stripping of the organic solvent 20 (see distillation stage 44 below). Accordingly, the non-aqueous performance fluid to explosive ratio (β) is in a predetermined range of 4 to 7, which enables optimal granulation of the resultant product, that is, the fluidized metallized energetic molding powder 42.

A dissolving operation 24 is performed in a vessel 26, for example, a lacquer tank 26, where binder components 28 are dissolved in the organic solvent 20 to form an homogenous, that is, a solution with uniform color and no precipitate, lacquer 32. The vessel 26 includes a tank portion and a mixing impeller. Accordingly, the binder components 28 are added to the organic solvent 20, and the impeller is energized to dissolve the binder components 28 into the organic solvent 20. The dissolving operation 24 is generally performed at an agitation speed in a predetermined range of about 10 rpm to about 50 rpm, a temperature range of about 20° C. to about 25° C., and a time range of about 24 hours to about 48 hours. Organic solvents 20 may, for example, include ethyl acetate or methyl ethyl ketone. An exemplary organic solvent 20 is ethyl acetate. Binder components 28 may, for example, include a polymeric binder 29, such as, a thermoplastic elastomer ("TPE"), and more particularly, for example, a polyacrylic elastomer, such as commercially known HYTEMP® 4454 (a commercial trademark of BF Goodrich, now available from Zeon Chemicals, Inc. of Kentucky). In an exemplary embodiment, the binder components 28 include TPE 29 and a plasticizer 30. The plasticizer 30 is added with the TPE 29 into the lacquer tank 26 to make the plasticizer polymer solution called a lacquer 32. Exemplary embodiments of the plasticizer 30 include dioctyl adipate ("DOA") or isodecyl pelargonate ("IDP").

A lacquer addition stage 34 is performed in the jacketed reactor 15. The lacquer 32 is added to the energetic solids and metal powder suspension 22 so that the binder components 28 of the lacquer 32 are substantially uniformly distributed to achieve a saturated solution 36, where saturation is generally controlled by the parameters bulk phase fluid to solvent (α) and solvent to polymer ratio (γ). If initial precipitation of the binder components 28 occurs before 80-90% of the lacquer 32 is added, then slightly more solvent is added to adjust the α to keep the binder in solution. Generally, about 80-90% of the lacquer is added to initiate precipitation. The lacquer addition stage 34 is generally performed at an agitation speed in a predetermined range of about 100 rpm to about 250 rpm, a temperature range of about 35° C. to about 65° C., at atmospheric pressure, a time range of about 30 minutes to about 60 minutes, and at the solvent to polymer ratio (γ) in a predetermined range of 14 to 18.

The solvent to polymer ratio (γ) is a parameter of the lacquer addition stage 34 for use in determining that the binder components 28 are completely solvated in excess of the organic solvent 20. A balance exists between maximizing solvent quantity for dissolving the binder components 28 in the dissolving operation 24 versus minimizing solvent quantity to simplify solvent removal during a distillation stripping operation 44. Accordingly, the binder components 28 are properly dissolved by making the lacquer 32 several hours prior to making the molding powder batch, that is, the saturated solution 36. In particular, in the lacquer addition stage 34, the lacquer 32 is slowly metered into the constantly agitated mixing impellers of the jacketed reactor 15, which contains the energetic solids and metal powder suspension 22. During the addition of the final amount of about 10-20% of the lacquer 32, "precipitation" begins. At this point, the final gamma (γ) is calculated. Accordingly, the solvent to polymer ratio (γ) is in a predetermined range of 14 to 18, which, as indicated above, is used to determine that the binder components 28 are completely solvated in excess of the organic solvent 20. The suspension for granulation is now a super-saturated solution 37, which includes the lacquer 32, fluidized energetic solids 38 and metal powder 12.

An optimization of granulation step 40 is performed in the jacketed reactor 15, where all of the lacquer 32 is added to the super-saturated solution 37. Upon addition, the lacquer 32 deposits on at least one of the fluidized energetic solids 38 and the metal powder 12 of the super-saturated solution 36 to cause granulation and formation of a fluidized metallized energetic molding powder 42. Additional bulk phase fluid 14 is generally added to increase particle size, and thus achieve a desired granulation size of the fluidized metallized energetic molding powder 42. This granulation function is controlled by the final ratio of bulk phase fluid to solvent (a) in a range of 15 to 25. The optimization of granulation step 40 is generally performed at an agitation speed in a predetermined range of about 100 rpm to about 250 rpm, a temperature in a predetermined range of about 40° C. to about 45° C., at atmospheric pressure, a time range of about 10 minutes to about 40 minutes, and also a ratio of bulk phase fluid to solvent (a) in a range of 15 to 25. The final a controls the amount of polymeric binder that precipitates onto the suspended solids, and therefore determines the size of the resultant molding powder granules.

A distillation operation 44 is performed in the jacketed reactor 15 by increasing the temperature to about 80° C. to about 88° C. The organic solvent vapor is condensed and recovered in a conventional condenser 46 and collection tank 43. As the distillation operation 44 strips the organic solvent 20 from the super saturated solution 37, the binder components previously in lacquer 32 are forced to precipitate onto the granulated fluidized metallized energetic molding powder 40. An end point of the distillation operation 44 is reached after about 120 minutes to about 180 minutes, as the binder components 28 rapidly precipitate, that is, "crash precipitation," on the energetic solids 38. The following parameters are optimized for this particular distillation operation. The distillation operation 44 is generally performed at an agitation speed in a predetermined range of 100 rpm to 250 rpm, a temperature in a predetermined range of about 80° C. to about 88° C., at atmospheric pressure, a time range of 120 minutes to 180 minutes, and a non-aqueous performance fluid to solvent ratio (α) in a predetermined range of 15 to 25.

The non-aqueous performance fluid to solvent ratio (α) is a parameter of the distillation operation 44. The non-aqueous performance fluid 14 suspends and separates the energetic solids 10, for example, nitramine particles, in a constantly agitated environment. The mass of non-aqueous performance fluid 14, or bulk phase fluid, is in excess of an amount of the organic solvent 20 used to solvate the binder components 28. Accordingly, the duration of distilling the organic solvent 20 is minimized to control the distillation rate. Further, the non-aqueous performance fluid 14 has a higher boiling point than the organic solvent 20, which allows distillation stripping of the organic solvent 20 and precipitation of the binder components 28 onto the energetic solids 10.

A reclaiming operation 47 is performed in separate distillation equipment 46 to reclaim and reuse the organic solvent 20 recovered from the lacquer 32 during the distillation operation 44. The reclaiming operation is generally performed at a temperature in a predetermined range of about 80° C. to about 88° C. and at atmospheric pressure. Upon completion, the organic solvent 20, which has been reclaimed and distilled, is sent to a holding tank 43 for reuse 49.

A decanting step 48 is performed by opening a dump valve (not shown) of the jacketed reactor 15 where the non-aqueous performance fluid 14 is separated from the fluidized metallized energetic molding powder 42. This step is designed to maximize the amount of wet metallized energetic molding powder 50, that is, the wet product, recovered from the jacketed reactor 15. The wet metallized energetic molding powder 50 is transferred from the jacketed reactor 15 to the screen filter structure 39 or onto "cheese cloth" for further processing.

Further, decanted non-aqueous performance fluid 51 is sent to a recovery tank 52 for further processing and recycling. An end point of the decanting step 48 is reached after about 20 minutes to about 30 minutes. The decanting step 48 is generally performed at ambient temperature and atmospheric pressure. Generally, about 80% to about 90% (by weight) of the bulk phase fluid 14 is decanted and is available for direct reuse.

A distillation operation 54, which uses conventional technique, is performed on the approximate 10-20% of the last decanted aliquot of non-aqueous performance fluid 51 in a distillation and condenser apparatus 56 in order to recycle the decanted non-aqueous performance fluid 51. In particular, the decanted non-aqueous performance fluid 51 is transferred from the recovery tank 52 to the distillation and condenser apparatus 56 where reclamation distillation is performed. The following parameters are optimized for this particular distillation operation. The distillation operation 54 is generally performed at a predetermined temperature range of about 90° C. to about 110° C. and at atmospheric pressure. The resultant reclaimed non-aqueous performance fluid 58 is sent to a bulk phase fluid tank 60, which holds the fluid for reuse 61.

A drying operation 62 is performed on the wet metallized energetic molding powder 50 in a convection oven 64. In particular, the wet metallized energetic molding powder 50 is transferred from the screen filter structure 39 onto trays 66 in the convection oven 64 where the wet metallized energetic molding powder 50 is dried. In an exemplary embodiment, the convection oven 64 is a forced air convection oven. The drying operation 62 is generally performed at a predetermined temperature range of about 50° C. to about 65° C., at atmospheric pressure, and a time range of about 24 hours to about 48 hours. The purpose of the drying operation is to produce a dry metallized energetic molding powder 68. In particular, the dry metallized energetic molding powder 68 is a high quality, free flowing molding powder product with a predetermined moisture content of at most, that is, less than or equal to (≦), 0.05% (wt.). The dry metallized energetic molding powder 68 has a uniform appearance when examined by hand and by microscopy. Further, the dry metallized energetic molding powder 68 has a free-flowing behavior, that is, an angle of repose is about 30 degrees when piled on a table top. In addition, the dry metallized energetic molder has an absence of discontinuities of metal powder. This absence permits the product to be made in large quantities or stored for long periods of time compared to the conventionally produced molding powders with density gradients and the related settling problems. (See Examples below).

An examination step 70 is performed on the dry metallized energetic molding powder 68 through a microscopy process to evaluate whether the dry metallized energetic molding powder 68 is a homogeneous, that is, the product has neither sharp edges nor reflects light when examined by optical microscopy, thus indicating dry metallized energetic molding powder without reflective surfaces or sharp edges of exposed energetic crystals. Accordingly, the dry metallized energetic molding powder 68 is structurally an energetic solid coated with a binder, and more particularly, a free flowing molding powder uniformly coated with a binder, for example, a plasticized binder. "Free flowing" means that the molding powder does not bond to self or cohere easily when handling. The uniform coating means that the nitramine is well coated or completely coated by a desensitizing binder, and the molding powder will be safer to handle.

A sensitivity evaluation step 70 is performed on the dry metallized energetic molding powder 68 using small-scale sensitivity tests to evaluate the sensitivity of the dry metallized energetic molding powder 68. In particular, the small-scale sensitivity tests determine whether the dry metallized energetic molding powder 68 is less sensitive to impact, friction and shock stimuli compared to conventional energetic molding powders, typically, a metal powder dry blended with an energetic molding powder. (See Examples, Table 5 below).

A scaling up process 72 is performed so various size tanks may be used and, in particular, different size batches may be made, for example, in a predetermined range of one (1) pint to ten (10) gallons to 100 gallons. As indicated, the above method primarily processes the energetic solids 10, the metal powder 12, and the bulk phase fluid 14 in the jacketed reactor 15 with a mixing impeller 18. A design parameter is calculated where an Impeller Reynolds Number is scaled as a function of tank diameter, for different sizes of mixers as indicated by the formula: where T=(equals) a tank diameter of the molder powder mixer, and $N_{Re}$=(equals) Impeller Reynolds Number. Further, $N_{Re}=(D_a^2 n\rho)/\mu$, where $D_a$=diameter of the agitator (m)

n=speed of the agitator (revolutions per second)

ρ=density of the fluid, or suspension (kg/m$^3$)

μ=viscosity of the fluid, or suspension (kg/s*m)

Based on these formulas, a predetermined range for the design parameter $N_{Re}/T$ is between about 550 to about 1,000 (about 550-about 1,000). This predetermined range allows essentially the same range of process parameters to be used when scaling-up from a small vessel to a larger vessel.

A pressing step 74 is performed on the dry metallized energetic molding powder 68 using standard press equipment by those skilled in the art of pressing exploives. These presses can range from 10 ton to 2,000 ton capacity, and are located in laboratories up to manufacturing buildings. In particular, the dry metallized energetic molding powder 68 is pressed into test units, ordnance components or warheads where these structures, importantly, have a uniform density, which as indicated above is a significant improvement over the molding powders with density gradients produced by con-ventional methods.

EXAMPLES

The invention will now be described with reference to the following examples, which are presented to elucidate the principals and advantages of aspects of the invention.

Table 1 (below) is a summary of the actual process data used with the above inventive method to make Products 3, 4, 5, and 6. The ranges reflect that the method was performed numerous times in the same size vessel before running the method again using a different size vessel. The drying operation was consistently run in an oven at a temperature range of 50-60° C. for 24-48 hours to produce the dry metallized energetic molding powder samples.

For example, Product 3 was made numerous times using the above inventive method in a one (1) pint vessel. The inventive steps are indicated below along with the corresponding parameters. Again, the steps were repeated numerous times, and thus the range of parameters.

Suspension: nitramine and metal powder samples were suspended in perfluorocarbon performance fluid at non-aqueous performance fluid to explosive ratios (β) of 5-7 where the suspension times were in a range of 10-25 minutes at about 35° C. to about 65° C.

Lacquer Addition Lacquer samples (ethyl acetate, elastomeric thermoplastic and plasticizer) were slowly added over a time range of 2-10 minutes to the suspended energetic solids. The lacquer additions were performed at solvent to polymer ratios (γ) of 14-18 and a temperature range of about 35° C. to about 65° C. for the samples.

Granulation Optimization: Ethyl acetate samples were added over a range of 5-30 minutes to achieve desired size granulation size of the molding powder samples. Granulation optimization was performed at non-aqueous performance fluid to solvent ratios (γ) of 12-16 and a temperature range of about 40° C. to about 45° C. for the samples.

Distillation: The fluidized metallized energetic molding powder samples were distilled over a time range of 15-45 minutes at about 80° C. to about 88° C. and at non-aqueous performance fluid to solvent ratios (α) of 12-16 to remove the ethyl acetate from the samples. Accordingly, the binder precipitated on the nitramine for the samples.

Decanting: The perfluorocarbon performance fluid was decanted and wet metallized energetic molding powder samples were formed.

Drying: The wet metallized energetic molding powder samples were dried in an oven at a temperature range of about 50° C. to about 65° C. for 24-48 hours.

Examination: The dry metallized energetic molding powder samples were examined to confirm formation of an homogeneous product.

TABLE 1

Examples of Process Data for Some Products

| Product | Vessel | α | β | γ | Suspension Time* (min) | Lacquer Add Time* (min) | Granulation Time** (min) | Distill Time*** (min) | Dry Powder[T] |
|---|---|---|---|---|---|---|---|---|---|
| Product 3 | 1 pint | 12-16 | 5-7 | 14-18 | 10-25 | 2-10 | 5-30 | 15-45 | 24-48 |
| | 10 gal | 15-22 | 5-7 | 14-18 | 10-30 | 10-20 | 10-40 | 45-90 | |
| | 100 gal | 15-25 | 5-7 | 14-18 | 30-60 | 30-60 | 10-40 | 120-180 | |
| Product 4 | 1 pint | 14-22 | 5-7 | 13-18 | 5-20 | 2-10 | 5-30 | 15-45 | |
| | 10 gal | 15-25 | 4-7 | 14-18 | 10-30 | 10-20 | 10-40 | 45-90 | |
| Product 5 | 1 pint | 14-22 | 5-7 | 13-18 | 5-20 | 2-10 | 5-30 | 15-45 | |
| | 10 gal | 15-25 | 4-7 | 14-18 | 10-30 | 10-20 | 10-40 | 45-90 | |
| Product 6 | 1 pint | 14-25 | 5-8 | 14-18 | 5-20 | 2-10 | 5-30 | 15-45 | |

*Temperature = about 35 to about 65° C.
**Temperature = about 40 to about 45° C.
***Temperature = about 80 to about 88° C.
[T]Temperature = about 50 to about 65° C.

In the Examples, Tables 2-4 indicate the following.

Table 2 indicates that using the above inventive method produced (actual results) a dry fluidized metallized energetic molding powder with an exemplary formulation, including HMX, dioctyl adipate, polyacrylic elastomer and aluminium powder and, more particularly, the aluminum powder is 30% (wt.).

TABLE 2

Example Formulation

| Component | Nominal % (wt) |
|---|---|
| Nitramine (bi-modal blend of grist sizes) | 64.4 |
| Dioctyl Adipate (DOA) | 4.2 |
| Polyacrylic Elastomer (HYTEMP 4454) | 1.4 |
| Aluminum Powder | 30.0 |

Table 3 indicates that using the above inventive method produced (actual results), five dry metallized energetic molding powder products, each product with a different formulation and, in particular, different amounts (% wt.) of metal powder. In particular, Product #4 and Product #5, respectively, include metal powder contents of 40% (wt.) and 50% (wt.). Sample Products #3-#5 have formulations with metal powder content in a predetermined range of about 30% (wt.) to about 50% (wt.) where these products have significantly reduced sensitivity problems as discussed below. These results contrast with molding powder produced by conventional methods, which limit the amount of metal powder content to about 30% due to settling issues and blending concerns as well having additional sensitivity problems. In addition, the above inventive method may be used (prophetic) to produce product with formulations, for example, including metal powder content up to 70% (wt.).

TABLE 3

Examples of Formulation Modifications

| Nomenclature | Nitramine % (wt) | Metal Powder % (wt) |
|---|---|---|
| Product # 1 | 84 | 10 |
| Product # 2 | 74 | 20 |
| Product # 3 | 64 | 30 |
| Product # 4 | 54 | 40 |
| Product # 5 | 44 | 50 |

Table 4 indicates that using the above inventive method produced (actual results), eleven (11) dry metallized energetic molding powder products, each product with a different formulation. In particular, these different product formulations include different components at different amounts (% wt.). In exemplary embodiments, the different components are water soluble and water-reactive components selected from nitramines, oxidizers, a nitrate ester, metals and a combustible powder.

TABLE 4

Examples of Products with Other Water Soluble and Water-Reactive Components

| Formulation | Nitramine #1 | Nitramine #2 | Oxidizer #1 | Oxidizer #2 | Oxidizer #3 | Nitrate Ester | Metal #1 | Metal #2 | Metal #3 | Combustible Powder |
|---|---|---|---|---|---|---|---|---|---|---|
| Product #6 | 64 | | | | | | | 30 | | |
| Product #7 | 54 | | | | | | | 40 | | |
| Product #8 | 44 | | | | 10 | | | 40 | | |
| Product #9 | 44 | | | | | 10 | | 40 | | 10 |
| Product #10 | 24 | | 30 | | | | 40 | | | |
| Product #11 | 24 | | 20 | | 10 | | 40 | | | |
| Product #12 | | 24 | 30 | | | | 40 | | | |
| Product #13 | | 24 | 20 | 10 | | | 30 | | 10 | |
| Product #14 | | 24 | 20 | | 10 | | 30 | | 10 | |
| Product #15 | 49 | | | | | 5 | 30 | | | 10 |
| Product #16 | 29 | | 20 | | | 5 | 30 | | | 10 |

Table 5 indicates that using the above inventive method produced (actual results), Product #3 and Product #5 are significantly less sensitive to impact, friction and shock compared to conventional energetic molding powders denoted as Conventional Art #1 and #2 produced by convention techniques.

TABLE 5

Comparison of Small-Scale Sensitivity Test Results

| Explosive | Impact NOL 12 Tools (50% ht, cm) | BAM Friction (N) | ESD Sensitivity (20/20 NF @) |
|---|---|---|---|
| Product # 3 | 50 | 360 | >8.33 J |
| Product # 5 | 60 | 360 | >8.33 J |
| Conventional Art # 1 | 35 | 252 | 0.165 J |
| Conventional Art # 2 | 40 | 252 | 0.095 J |
| RDX | 20 | 84 | 0.037 J |

The above experimental molding powder products produced using the above inventive method showed impressive properties, including relatively large amounts of metal powder content and low sensitivity.

Additional advantages and modifications will readily occur to those skilled in the art upon reference to the disclosure. Therefore, the invention in its broader aspects is not limited to the specific details, representative devices and methods, and illustrative examples shown and described. Accordingly, departures may be made from such details without departing from the spirit or scope of the general inventive concept as defined by the appended claims and their equivalents.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A method for making blast explosive molding powder, comprising:

suspending energetic solids, which is other than an inorganic oxidizing agent, and a metal powder in a non-aqueous bulk phase fluid at a non-aqueous bulk phase fluid to explosive ratio by weight using a molding powder vessel so that the non-aqueous bulk phase fluid separates the energetic solids for forming an energetic solids and metal powder suspension for promoting a formation of properly sized molding powder granules during a distillation stripping of an organic solvent component where said suspending energetic solids and said metal powder is performed at a non-aqueous performance fluid to explosive ratio in a range of 4:1 to 7:1;

adding lacquer to the energetic solids and metal powder suspension at a solvent of the lacquer to polymer ratio for achieving a mixture, said mixture comprising a lacquer, fluidized energetic solids and metal powder;

optimizing of granulation for final granulation of the mixture at a non-aqueous bulk phase fluid to solvent ratio by weight in a range to form a fluidized metallized energetic molding powder;

distilling the fluidized metallized energetic molding powder through a first distillation process to remove the organic solvent component of the lacquer;

reclaiming the organic solvent component through the first distillation process;

decanting the non-aqueous bulk phase fluid for recovering a wet metallized energetic molding powder;

reclaiming the non-aqueous bulk phase fluid through a second distillation process for reuse of the non-aqueous bulk phase fluid; and drying the wet metallized energetic molding powder in an oven to form a dry metallized energetic molding powder, wherein said solvent of the lacquer to polymer ratio by weight is in a range of 14:1 to 18:1.

2. The method according to claim 1, wherein said energetic solids comprise nitramine molding powders.

3. The method according to claim 1, wherein said non-aqueous bulk phase fluid is said non-aqueous performance fluid.

4. The method according to claim 1, wherein said adding lacquer is performed in a range of solvent of the lacquer to polymer ratio by weight.

5. The method according to claim 1, wherein said lacquer is formed from at least one of an organic solvent and a binder.

6. The method according to claim 1, wherein said optimizing of granulation for final granulation is performed in a range at a non-aqueous bulk-phase fluid to solvent ratio by weight.

7. The method according to claim 1, wherein said distilling the fluidized metallized energetic molding powder is performed in a range at a non-aqueous bulk-phase fluid to solvent ratio by weight.

8. The method according to claim 1, wherein said suspending includes said energetic solids are added about simultaneously with said metal powder in said bulk phase fluid.

9. The method according to claim 1, wherein said suspending includes said energetic solids are added separately from said metal powder in said non-aqueous bulk phase fluid.

10. The method according to claim 1, wherein said suspending further comprises suspending said energetic solids, said metal powder and at least one of a water-soluble oxidizer and a non-water soluble oxidizer in said non-aqueous bulk phase fluid.

11. A method for making blast explosive molding powder, comprising:

suspending energetic solids, which is other than an inorganic oxidizing agent, and a metal powder in a non-aqueous bulk phase fluid at a non-aqueous bulk phase fluid to explosive ratio by weight using a molding powder vessel so that the non-aqueous bulk phase fluid separates the energetic solids in order to form an energetic solids and metal powder suspension for promoting a formation of properly sized molding powder granules during a distillation stripping of an organic solvent component where said suspending energetic solids and said metal powder is performed at a non-aqueous performance fluid to explosive ratio in a range of 4:1 to 7:1;

dissolving binder components in organic solvent to make a lacquer using a vessel;

adding the lacquer to the energetic solids and metal powder suspension at a solvent of the lacquer to polymer ratio for achieving a mixture, said mixture comprising a lacquer, fluidized energetic solids and metal powder;

wherein said adding lacquer comprises the lacquer is precipitated on at least one of the fluidized energetic solids and the metal powder to result in granulation of and formation of a fluidized metallized energetic molding powder;

optimizing of granulation for final granulation of the mixture at a non-aqueous bulk phase fluid to solvent ratio by weight in a range to form a fluidized metallized energetic molding powder;

distilling the fluidized metallized energetic molding powder through a first distillation process for removing the organic solvent component of the lacquer;

reclaiming the organic solvent component through the first distillation process;

decanting the non-aqueous bulk phase fluid for recovering a wet metallized energetic molding powder;

reclaiming the non-aqueous bulk phase fluid through a second distillation process for reuse of the non-aqueous bulk phase fluid; and drying the wet metallized energetic molding powder in an oven to form a dry metallized energetic molding powder, wherein said solvent of the lacquer to polymer ratio by weight is in a range of 14:1 to 18:1.

12. The method according to claim 11, wherein said non-aqueous bulk phase fluid is said non-aqueous performance fluid.

13. The method according to claim 11, wherein said distilling the fluidized metallized energetic molding powder is performed at a non-aqueous performance fluid to solvent ratio by weight in a range of 15:1 to 25:1.

14. The method according to claim 11, wherein said optimizing of granulation for final granulation is performed at said non-aqueous bulk phase fluid to solvent ratio by weight in said range of 15:1 to 25:1.

15. The method according to claim 11, wherein said fluidized metallized energetic molding powder is comprised of a fluidized energetic solid coated with a binder component.

16. The method according to claim 11, further comprising examining said dry metallized energetic molding powder through microscopy to confirm that said dry metallized energetic molding powder comprises non-reflective surfaces; and evaluating said dry metallized energetic molding powder through a sensitivity test to calculate a sensitivity to at least one of impact, friction and electrostatic discharge.

17. The method according to claim 11, further comprising scaling, up production of the dry metallized energetic molding powder from an experimental stage to a production stage; and pressing said dry metallized energetic molding powder into at least one of a test unit, an ordnance component and warhead.

18. The method according to claim 11, wherein said dry metallized energetic molding powder is a uniform gradient dry metallized energetic molding powder.

19. The method according to claim 11, wherein said binder components is comprised of a polymeric binder.

20. A method for making blast explosive molding powder, comprising:

suspending energetic solids, which is other than an inorganic oxidizing agent, and a metal powder in a non-aqueous performance fluid at a non-aqueous performance fluid to explosive ratio by weight in a range of 4:1 to 7:1 using a molding powder vessel so that the non-aqueous bulk phase fluid separates the energetic solids in order to form an energetic solids and metal powder suspension, for promoting a formation of properly sized molding powder granules during a distillation stripping of an organic solvent component;

dissolving binder components in organic solvent to make a lacquer using a vessel;

adding the lacquer to the energetic solids and metal powder suspension at a solvent of the lacquer to polymer ratio in a range of 14:1 to 18:1 to achieve a mixture, said mixture comprising a lacquer, fluidized energetic solids and metal powder, wherein adding the lacquer comprises the lacquer is precipitated on at least one of the fluidized energetic solids and the metal powder to result in granulation of and formation of a fluidized metallized energetic molding powder;

optimizing of granulation for final granulation of the mixture at a non-aqueous performance fluid to solvent ratio by weight in a range of 15:1 to 25:1 to form a fluidized metallized energetic molding powder;

distilling the fluidized metallized energetic molding powder through a first distillation process at a non-aqueous performance fluid to solvent ratio by weight in a range of 15:1 to 25:1 to remove an organic solvent component of the lacquer, reclaiming the organic solvent component through the first distillation process;

decanting the non-aqueous performance fluid to recover a wet metallized energetic molding powder;

reclaiming the non-aqueous performance fluid through a second distillation process for reuse of the non-aqueous performance fluid; and drying the wet metallized energetic molding powder in an oven to form a dry metallized energetic molding powder, wherein said solvent of the lacquer to polymer ratio by weight is in a range of 14:1 to 18:1.

21. The method according to claim 20, wherein said non-aqueous performance fluid is a non-aqueous perfluorocarbon performance fluid.

22. The method according to claim 20, wherein said suspending, said adding said lacquer, said optimizing for final granulation and said distilling are in a jacketed reactor.

23. The method according to claim 20, wherein said dry metallized energetic molding powder is comprised of an energetic solid coated with a binder component.

24. The method according to claim 20, wherein said suspending further comprises suspending said energetic solids, said metal powder and at least one of ammonium perchlorate, commercial double base propellant, trimethylolethane trinitrate, flaked aluminum powder and bituminous coal powder in said non-aqueous performance fluid.

25. The method according to claim 20, further comprising scaling up production of the dry metallized energetic molding powder from an experimental stage to a production stage using a design parameter $N_{Re}/T$ in a range between about 550 to about 1,000.

* * * * *